US011303048B2

(12) United States Patent
Maier et al.

(10) Patent No.: US 11,303,048 B2
(45) Date of Patent: Apr. 12, 2022

(54) PLUG CONNECTOR FOR ELECTRICALLY CONNECTING A TAG CONNECTOR TO AN ELECTRICAL LINE OF A MOTOR-DRIVEN GARDEN AND/OR FORESTRY WORKING APPARATUS, AND MOTOR-DRIVEN GARDEN AND/OR FORESTRY WORKING APPARATUS

(71) Applicant: Andreas Stihl AG & Co. KG, Waiblingen (DE)

(72) Inventors: Georg Maier, Kernen im Remstal (DE); Michael Schneider, Fellbach (DE); Mario Haefele, Winnenden (DE); Rolf Walter, Beinstein (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 17/108,556

(22) Filed: Dec. 1, 2020

(65) Prior Publication Data

US 2021/0167525 A1 Jun. 3, 2021

(30) Foreign Application Priority Data

Dec. 2, 2019 (EP) ..... 19212869

(51) Int. Cl.
*H01R 4/48* (2006.01)
*H01R 4/18* (2006.01)
(Continued)

(52) U.S. Cl.
CPC ..... *H01R 4/48* (2013.01); *H01R 4/185* (2013.01); *H01R 11/22* (2013.01); *H01R 13/115* (2013.01)

(58) Field of Classification Search
CPC ... H01R 4/48; H01R 4/28; H01R 4/26; H01R 4/00; H01R 4/185; H01R 4/18;
(Continued)

(56) References Cited

U.S. PATENT DOCUMENTS 3,546,664 A * 12/1970 De Bolt ..... H01R 13/115 439/866
3,885,853 A 5/1975 Reimer
(Continued)

FOREIGN PATENT DOCUMENTS

DE 25 51 970 A1 8/1976
DE 19 852 877 A1 5/1999
FR 2 842 028 A1 1/2004

*Primary Examiner* — Harshad C Patel
(74) *Attorney, Agent, or Firm* — Crowell & Moring LLP

(57) ABSTRACT

A plug connector for electrically connecting a tag connector to an electrical line of a motor-driven garden and/or forestry working apparatus includes a tag connector receptacle portion and a line receptacle portion. The tag connector receptacle portion has a first surface-clamping leg, a second surface-clamping leg, a first peripheral guiding blade and a second peripheral guiding blade, wherein the surface-clamping legs are disposed so as to be opposite one another and wherein the peripheral guiding blades are disposed so as to be opposite one another. The tag connector receptacle portion is configured for elastically enlarging a leg spacing between the surface-clamping legs and for plastically enlarging a blade spacing between the peripheral guiding blades by interaction between the peripheral guiding blades and the tag connector for receiving the tag connector and for contacting and for impinging with a clamping force opposite surfaces of the received tag connector by the surface-clamping legs, and for contacting opposite peripheries of the received tag connector by the peripheral guiding blades for securing the received tag connector against being released from the tag connector receptacle portion and for electrical
(Continued)

contacting. The line receptacle portion is electrically connected to the tag connector receptacle portion. The line receptacle portion is configured for receiving the electrical line and for securing the received line against being released from the line receptacle portion and for electrical contacting.

15 Claims, 8 Drawing Sheets

(51) Int. Cl.
*H01R 11/22* (2006.01)
*H01R 13/115* (2006.01)

(58) Field of Classification Search
CPC ..... H01R 11/22; H01R 11/11; H01R 13/111; H01R 13/11; H01R 13/10; H01R 13/04; H01R 13/02; H01R 13/00
USPC ..... 439/828
See application file for complete search history.

(56) References Cited

U.S. PATENT DOCUMENTS

| | | | | | |
|---|---|---|---|---|---|
| 4,029,384 | A * | 6/1977 | Reinwall, Jr. | H01R 4/245 | 439/397 |
| 4,993,959 | A * | 2/1991 | Randolph | H01R 4/64 | 439/92 |
| 5,451,167 | A * | 9/1995 | Zielinski | H01R 4/245 | 439/435 |
| 6,106,310 | A * | 8/2000 | Davis | H01R 4/26 | 439/92 |
| 6,247,961 | B1 * | 6/2001 | McCoy | H01R 4/4809 | 439/439 |
| 6,276,947 | B1 * | 8/2001 | Homfeldt | H01R 4/48 | 439/92 |
| 8,590,223 | B2 * | 11/2013 | Kilgore | H02S 20/24 | 52/173.3 |
| 10,141,662 | B2 * | 11/2018 | Bernard | H01R 4/2437 | |
| 10,208,874 | B2 * | 2/2019 | Geiger | F16L 3/04 | |
| 10,253,905 | B2 * | 4/2019 | Martin | F16L 3/1218 | |
| 10,847,960 | B1 * | 11/2020 | Naugler | F16B 2/245 | |
| 10,852,038 | B2 * | 12/2020 | Rothschild | H02S 30/10 | |
| 2014/0220834 | A1 | 8/2014 | Rizzo | | |

* cited by examiner

PLUG CONNECTOR FOR ELECTRICALLY CONNECTING A TAG CONNECTOR TO AN ELECTRICAL LINE OF A MOTOR-DRIVEN GARDEN AND/OR FORESTRY WORKING APPARATUS, AND MOTOR-DRIVEN GARDEN AND/OR FORESTRY WORKING APPARATUS

CROSS REFERENCE TO RELATED APPLICATION

This application claims priority under 35 U.S.C. § 119 from European Patent Application No. 19 212 869.2, filed Dec. 2, 2019, the entire disclosure of which is herein expressly incorporated by reference.

BACKGROUND AND SUMMARY OF THE INVENTION

The invention relates to a plug connector for electrically connecting a tag connector to an electrical line of a motor-driven garden and/or forestry working apparatus, and to a motor-driven garden and/or forestry working apparatus having a tag connector, an electrical line, and such a plug connector.

The invention is based on the object of providing a plug connector for electrically connecting a tag connector to an electrical line of a motor-driven garden and/or forestry working apparatus, wherein the plug connector has improved properties, and a motor-driven garden and/or forestry working apparatus having such a plug connector.

This object is achieved by providing a plug connector and a motor-driven garden and/or forestry working apparatus according to the claimed invention.

The plug connector according to the invention for electrically connecting a tag connector to an electrical line of a motor-driven garden and/or forestry working apparatus has a tag connector receptacle portion and a line receptacle portion. The tag connector receptacle portion has a first surface-clamping leg, a second surface-clamping leg, a first peripheral guiding blade, and a second peripheral guiding blade. The surface-clamping legs are disposed so as to be opposite one another. The peripheral guiding blades are disposed so as to be opposite one another. The tag connector receptacle portion is configured or designed, respectively, for elastically enlarging a leg spacing between the surface-clamping legs and for plastically enlarging a blade spacing between the peripheral guiding blades by means of in particular direct interaction between the peripheral guiding blades and the tag connector for receiving the tag connector between the surface-clamping legs and the peripheral guiding blades, and for contacting and for impinging with a clamping force opposite surfaces of the received tag connector by means of the surface-clamping legs, and for contacting opposite peripheries of the received tag connector by means of the peripheral guiding blades for securing the received tag connector against being released from the tag connector receptacle portion and for electrical contacting. The line receptacle portion is in particular electrically connected to the tag receptacle portion and mechanically connected to the latter. The line receptacle portion is configured or designed, respectively, for receiving the electrical line and for securing the received line against being released from the line receptacle portion and for electrical contacting.

The plug connector enables, and in particular the elastic enlargement of the leg spacing and the plastic enlargement of the blade spacing enable, the plug connector to be individually adapted to the tag connector, in particular to a tolerance-affected thickness of the tag connector and to a tolerance-affected width of said tag connector. The plug connector, in particular the tag connector receptacle portion, thus enables the tag connector to be received without play, or to sit without play, respectively, and thus enables the received tag connector to be relatively well secured against being released from the tag connector receptacle portion, in particular in the case of vibrations or accelerations of up to 1000 meters per second$^2$ (m/s$^2$) caused by the motor-driven garden and/or forestry working apparatus, in particular a drive motor such as, for example, an internal combustion engine, of the garden and/or forestry working apparatus, and/or also in the case of the same tag connector being received or plugged into the same tag connector receptacle portion multiple times, respectively, and/or also in the case of the same tag connector receptacle portion being plugged onto the same tag connector multiple times, respectively. The plug connector, in particular the tag connector receptacle portion, thus enables the received tag connector to be electrically contacted in a relatively reliable manner. Furthermore, the surface-clamping legs and the peripheral guiding blades can in each case enable electrical contacting of the received tag connector and thus enable a redundancy in terms of the electrical contacting of the received tag connector.

The plug connector can in particular be referred to as a contact spring or contact plug.

The tag connector can be referred to as a latch plate. Additionally or alternatively, the tag connector can be plate-shaped.

The electrical line can be a cable or a conductor.

The tag connector receptacle portion and the line receptacle portion may be dissimilar. Additionally or alternatively, the first surface-clamping leg, the second surface-clamping leg, the first peripheral guiding blade and/or the second peripheral guiding blade may be dissimilar.

The tag connector receptacle portion for elastically enlarging the leg spacing can be configured in a region in which the surface-clamping legs contact the received tag connector. Additionally or alternatively, the tag connector receptacle portion for elastically enlarging the leg spacing can be configured between a free end/free ends of the first surface-clamping leg and/or of the second surface-clamping leg. Furthermore additionally or alternatively, the tag connector receptacle portion can be configured for elastically enlarging the leg spacing by at least 10 percent (%), in particular at least 20%, in particular at least 50%, in particular at least 100%. Furthermore additionally or alternatively, the tag connector receptacle portion can be configured for plastically enlarging the leg spacing. Furthermore additionally or alternatively, the surface-clamping legs can be referred to as spring legs.

The tag connector receptacle portion for plastically enlarging the blade spacing can be configured in a region in which the peripheral guiding blades contact the received tag connector. Additionally or alternatively, the tag connector receptacle portion for plastically enlarging the blade spacing can be configured between a free end/free ends of the first peripheral guiding blade and/or of the second peripheral guiding blade. Furthermore additionally or alternatively, the tag connector receptacle portion can be configured for plastically enlarging the blade spacing by at least 1%, in particular at least 2%, in particular at least 5%, in particular at least 10%. Furthermore additionally or alternatively, the plastic enlargement of the blade spacing can take place when the tag connector is initially received in or initially plugged into the tag connector receptacle portion, respectively, or when the tag connector receptacle portion is initially plugged onto the tag connector, respectively.

The tag connector receptacle portion can be configured for elastically enlarging the leg spacing and for plastically enlarging the blade spacing in a mutually independent manner.

A value of a force for receiving the tag connector in the tag connector receptacle portion, or for plugging the tag connector into the tag connector receptacle portion, respectively, or for plugging the tag connector receptacle portion onto the tag connector, in particular in a tag connector receiving direction, respectively, can be at least 10 Newtons (N), in particular at least 20 N, and/or at most 40 N, in particular 30 N. Additionally or alternatively, a force for releasing the received tag connector from the tag connector receptacle portion, in particular counter to the tag connector receiving direction, can be at least 10 Newtons (N), in particular at least 20 N, and/or at most 40 N, in particular 30 N.

The tag connector receptacle portion can in particular be connected to the received tag connector in a force-fitting manner and a form-fitting manner. Additionally or alternatively, the tag connector receptacle portion does not have to be connected to the received tag connector in a materially integral manner.

The line receptacle portion can in particular be connected to the received electrical line in a force-fitting manner and a form-fitting manner. Additionally or alternatively, the line receptacle portion does not have to be connected to the received line in a materially integral manner.

The line receptacle portion can be configured as a release aid, or a disassembly aid, respectively.

The line receptacle portion can have a strain relief for the in particular received electrical line.

The plug connector can be configured so as to be in one part or integral, respectively. The plug connector can thus be relatively robust, in particular in comparison to a plug connector in multiple parts which over time can fall apart on account of a permanent stress by vibrations.

The plug connector can be partially or completely composed of an electrically conducting material. The plug connector can in particular be partially or completely composed of steel, tin-plated steel, nickel-plated steel, bronze, tin-plated bronze, brass and/or tin-plated brass. Additionally or alternatively, the plug connector can be configured for an electric current of at least 5 milliamperes (mA), in particular of at least 10 mA, and/or of at most 100 mA, in particular of at most 50 mA, in particular of 20 mA. Furthermore additionally or alternatively, the plug connector can be configured for an electrical voltage of at least 5 Volts (V), in particular of at least 10 V, and/or of at most 100 V, in particular of at most 50 V, in particular of 25 V. Furthermore additionally or alternatively, the plug connector, in particular the tag connector receptacle portion, can be configured for a transition resistance to the received tag connector of at most 3 Ohms (Ω), in particular of at most 300 milliohms (mΩ), in particular of at most 30 mΩ, in particular of at most 3 mΩ.

In one refinement of the invention the surface-clamping legs and the peripheral guiding blades are mutually disposed in such a manner that a blade spacing direction, in particular of the blade spacing, runs so as not to be parallel, in particular so as to be orthogonal, to a leg spacing direction, in particular of the leg spacing.

Additionally or alternatively, the first surface-clamping leg, the first peripheral guiding blade, the second surface-clamping leg, and the second peripheral guiding blade are disposed in this sequence about a tag connector receiving direction.

This, in particular the non-parallel profile and/or the sequence, enable/enables that the peripheral guiding blades can offer lateral support in particular in the blade spacing direction, such that the tag connector receptacle portion cannot slide off the received tag connector to one side, in particular in the blade spacing direction. Additionally or alternatively, this, in particular the non-parallel profile and/or the sequence, enable/enables the tag connector receptacle portion to be centred on the tag connector.

In particular, the surface-clamping legs and the peripheral guiding blades can describe a rectangular shape. Additionally or alternatively, the tag connector receiving direction can run so as not to be parallel, in particular so as to be orthogonal, to the blade spacing direction and/or to the leg spacing direction.

In one refinement of the invention the first peripheral guiding blade, in particular in mechanical terms and electrically, is connected directly in particular either to the first surface-clamping leg or to the second surface-clamping leg.

Additionally or alternatively, the second peripheral guiding blade, in particular in mechanical terms and electrically, is connected directly in particular either to the first surface-clamping leg or to the second surface-clamping leg.

This enables a relatively simple construction and/or a relatively simple production of the plug connector, in particular of the tag connector receptacle portion.

In one refinement of the invention, the peripheral guiding blades from the first surface-clamping leg extend in the direction, in particular in a leg spacing direction, of the second surface-clamping leg, in particular up to the second surface-clamping leg.

Additionally or alternatively, the peripheral guiding blades in a tag connector receiving direction, in particular the tag connector receiving direction, are disposed in a central region of the surface-clamping legs.

Furthermore additionally or alternatively, the peripheral guiding blades in the tag connector receiving direction are at most 50%, in particular at most 40%, of the length or the height, respectively, of the surface-clamping legs.

This, in particular the extent, enables that the peripheral guiding blades can offer lateral support, in particular in a blade spacing direction, such that the tag connector receptacle portion cannot slide off from the received tag connector to one side, in particular in the blade spacing direction. Additionally or alternatively, this, in particular the extent, enables the tag connector receptacle portion to be centred on the tag connector.

This, in particular the disposal and/or the length, enable/enables a relatively simple and/or a relatively material-saving production of the plug connector, in particular of the tag connector receptacle portion.

The tag connector receptacle portion can in particular be configured for plastically enlarging the blade spacing in a region of the second surface-clamping leg. Additionally or alternatively, disposed in the central region can mean that the peripheral guiding blades in and/or counter to the tag connector receiving direction can be disposed so as to be spaced apart from ends of the surface-clamping legs. Furthermore additionally or alternatively, the tag connector receptacle portion can be configured for elastically enlarging the leg spacing in the central region. Furthermore additionally or alternatively, the peripheral guiding blades in the tag connector receiving direction can be at least 5%, in particular at least 10%, in particular 20% of the length of the surface-clamping legs.

In one refinement of the invention, the peripheral guiding blades in a tag connector receiving direction, in particular the tag connector receiving direction, are at least 1 millimetre (mm) and/or at most 4 mm, in particular 2.5 mm, long or high, respectively.

Additionally or alternatively, the surface-clamping legs in the tag connector receiving direction are at least 3 mm and/or at most 9 mm, in particular 6 mm, long or high, respectively.

Further additionally or alternatively, the leg spacing is at least 1 mm and/or at most 3 mm, in particular 2 mm, in particular in the case of a received tag connector.

Furthermore additionally or alternatively, the blade spacing is at least 3 mm and/or at most 7 mm, in particular 5 mm, in particular in the case of a received tag connector.

Furthermore additionally or alternatively, the leg spacing is at most 50%, in particular at most 40%, of the blade spacing, in particular in the case of a received tag connector.

Furthermore additionally or alternatively, the surface-clamping legs and/or the peripheral guiding blades are at least 0.25 and/or at most 0.75 mm, in particular 0.5 mm, thick.

This dimension or these dimensions enables/enable a positive compromise between a value of a force for receiving and a value of a force for releasing. Additionally or alternatively, the dimensions enable relatively large surface-clamping legs for relatively minor stresses and a relatively high clamping force or contact force, respectively.

In particular, the leg spacing prior to the tag connector being initially received in the tag connector receptacle portion can be 0 mm, or a free end/free ends of the first surface-clamping leg and/or of the second surface-clamping leg can contact the other surface-clamping leg, respectively. Additionally or alternatively, the leg spacing can be at least 5%, in particular at least 10%, in particular at least 20% of the blade spacing, in particular in the case of a received tag connector. Furthermore additionally or alternatively, a width of the peripheral guiding blades, in particular in the leg spacing direction, can correspond to the leg spacing, in particular be equal to the latter, in particular in the case of a received tag connector. Furthermore additionally or alternatively, a width of the surface-clamping legs, in particular in the blade spacing direction, can correspond to the blade spacing, in particular be equal to the latter.

In one refinement of the invention the plug connector, in particular the tag connector receptacle portion, in a tag connector receiving direction, in particular the tag connector receiving direction, in an end region of the surface-clamping legs has a plug-fit delimitation and/or user compression portion. The plug-fit delimitation and/or user compression portion is configured or designed, respectively, for delimiting in particular in a form-fitting manner the receptacle of the tag connector, in particular by means of contacting the tag connector, and/or for pressing the tag connector receptacle portion in a user-activatable manner onto the tag connector. This enables a relatively simple, in particular working apparatus-free and manual, assembly, of the tag connector receptacle portion on the tag connector. In particular, the end region can be different and/or spaced apart from a free end/free ends of the first surface-clamping leg and/or of the second surface-clamping leg. Additionally or alternatively, the plug-fit delimitation and/or user compression portion can be configured for electrically contacting the received tag connector. Furthermore additionally or alternatively, the plug-fit delimitation and/or user compression portion can run so as not to be parallel, in particular so as to be orthogonal, to the tag connector receiving direction and/or so as to be parallel to a leg spacing direction and/or a blade spacing direction.

In one design embodiment of the invention the surface-clamping legs, in particular in mechanical terms and electrically, are connected to one another by means of the plug-fit delimitation and/or user compression portion.

Additionally or alternatively, the plug-fit delimitation and/or user compression portion is curved or bulged, respectively, towards the inside, in particular in an inwardly convex and/or an externally concave manner, or counter to the tag connector receiving direction, respectively.

This, in particular the connection, enables a relatively simple construction and/or a relatively simple production of the plug connector, in particular of the tag connector receptacle portion.

This, in particular the curvature, enables that the leg spacing prior to the tag connector being initially received in the tag connector receptacle portion can be 0 mm, or respectively that a free end/free ends of the first surface-clamping leg and/or of the second surface-clamping leg can contact the other surface-clamping leg.

In particular, the surface-clamping legs in mechanical terms to not have to be connected to one another by means of the peripheral guide blades. Additionally or alternatively, the tag connector receptacle portion does not have to be configured for elastically enlarging the leg spacing in the end region.

In one refinement of the invention the first surface-clamping leg and/or the second surface-clamping leg in a leg plug-fit region for the tag connector, in particular the tag connector to be received, for interacting with the tag connector for elastically enlarging the leg spacing are/is moulded in particular so as to be oblique.

Additionally or alternatively, the first peripheral guiding blade and/or the second peripheral guiding blade in a blade plug-fit region for the tag connector for interacting with the tag connector, in particular the tag connector to be received, for plastically enlarging the blade spacing are/is moulded in particular so as to be oblique. In particular, the first peripheral guiding blade and/or the second peripheral guiding blade have/has an introduction ramp/introduction ramps.

This, in particular the shape of the first surface-clamping leg and/or of the second surface-clamping leg, enables tilting to be avoided when the tag connector is received in the tag connector receptacle portion and thus enables relatively simple receiving.

In particular, the leg plug-fit region can be at a free end/free ends of the first surface-clamping leg and/or of the second surface-clamping leg. Additionally or alternatively, a free end/free ends of the first surface-clamping leg and/or of the second surface-clamping leg can be angled towards the outside. Furthermore additionally or alternatively, the first surface-clamping leg and/or the second surface-clamping leg in the leg plug-fit region can be moulded so as to be oblique to a tag connector receiving direction. Furthermore additionally or alternatively, the first peripheral guiding blade and/or the second peripheral guiding blade in the blade plug-fit region can be moulded so as to be oblique to the tag connector receiving direction.

In one refinement of the invention the line receptacle portion in particular either, in a tag connector receiving direction, in particular the tag connector receiving direction, is disposed so as to be level with a leg plug-fit region, in particular the leg plug-fit region, of the first surface-clamping leg and/or of the second surface-clamping leg for the tag connector, or counter to the tag connector receiving direction so as to be spaced apart from the leg plug-fit region. This enables a relatively positive disposal of the received electrical line, in particular of a centre of gravity of the line, and thus relatively positive securing of the received tag connector against being released from the tag connector receptacle portion, in particular in the case of vibrations in the line.

In one refinement of the invention the peripheral guiding blades in particular in mechanical terms and electrically are connected directly to the first surface-clamping leg. The second surface-clamping leg, in particular in mechanical terms and electrically, is connected to the line receptacle portion by means of the first surface-clamping leg. This enables a relatively central disposal of the components of the plug connector, in particular proceeding from the first surface-clamping leg, and thus relatively positive securing of the received tag connector against being released from the tag connector receptacle portion.

In one refinement of the invention the tag connector receptacle portion, in particular the first surface-clamping leg or the second surface-clamping leg, and the line receptacle portion, in particular in mechanical terms and electrically, are connected to one another by means of an in particular bent spring portion. This enables a transmission of vibrations, to the extent that the latter are present, of the received electrical line to the tag connector receptacle portion to be reduced or even to be avoided, and thus relatively good securing of the received tag connector against being released from the tag connector receptacle portion. Additionally or alternatively, this enables a risk of the received line breaking on the line receptacle portion to be reduced or even to be avoided. In particular, the line receptacle portion by means of the spring portion can be bent away from the tag connector receptacle portion, in particular counter to a leg spacing direction.

In one refinement of the invention the tag connector receptacle portion and the line receptacle portion are mutually disposed in such a manner that a line receiving direction runs so as not to be parallel, in particular so as to be orthogonal, to a tag connector receiving direction, in particular the tag connector receiving direction, in particular so as to be parallel to a blade spacing direction, in particular the blade spacing direction. This enables a transmission of vibrations, to the extent that the latter are present, of the received electrical line to the tag connector receptacle portion to be reduced or even to be avoided, and thus relatively good securing of the received tag connector against being released from the tag connector receptacle portion. In particular, the line receiving direction can be parallel to a longitudinal axis of the received line.

In one refinement of the invention the line receptacle portion is configured or designed, respectively, so as to form a crimp connection, in particular a B crimp connection and/or an overlapping crimp connection, to the electrical line. The crimp connection, in particular the B crimp connection, enables relatively simple processing, in particular in comparison to a rolled crimp connection and/or to crimping of two electrical lines.

In one refinement of the invention the plug connector has a stamped-and-bent part, in particular free of any welded connection, or is in particular a stamped-and-bent part. This enables a relatively simple and thus relatively cost-effective production of the plug connector.

The motor-driven garden and/or forestry working apparatus according to the invention has a tag connector, an electrical line, and a plug connector as has been described above. The plug connector electrically connects the, in particular received, tag connector to the, in particular received, line.

The tag connector can in particular be configured as described above. Additionally or alternatively, the electrical line can be configured as described above. Furthermore additionally or alternatively, the motor-driven garden and/or forestry working apparatus can be configured as described above.

The motor-driven garden and/or forestry working apparatus can have an in particular electrical and/or cylinder-proximal motor control unit, in particular having an ignition module. The motor control unit, in particular the ignition module, can have the tag connector.

The garden and/or forestry working apparatus can be a hand-guided, in particular hand-supported, or ground-guided, garden and/or forestry working apparatus. A hand-guided, in particular hand-supported, garden and/or forestry working apparatus can in particular mean that the garden and/or forestry working apparatus can have a mass of at most 50 kilograms (kg), in particular of at most 20 kg, in particular of at most 10 kg.

The garden and/or forestry working apparatus can be a saw, a pole branch cutter, a brush cutter, a hedge cutter, a hedge trimmer, a blower, a leaf blower, a pair of pruning shears, an angle grinder, a sweeping apparatus, a sweeper roller, a sweeper brush, a lawn mower, a lawn scarifier, or a grass cutter.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 8:
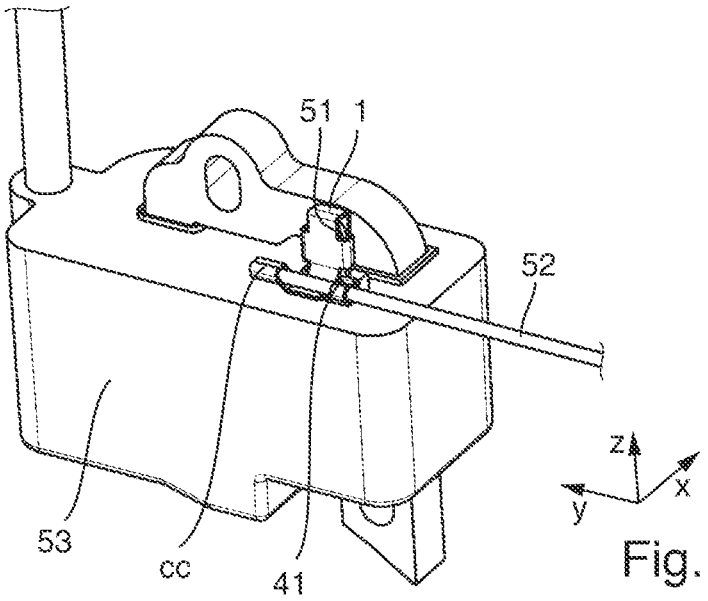
FIG. 8 shows a further perspective view of the plug connector of FIG. 1, having the received tag connector of a motor control unit and a received electrical line of the motor-driven garden and/or forestry working apparatus.
Figure 9:
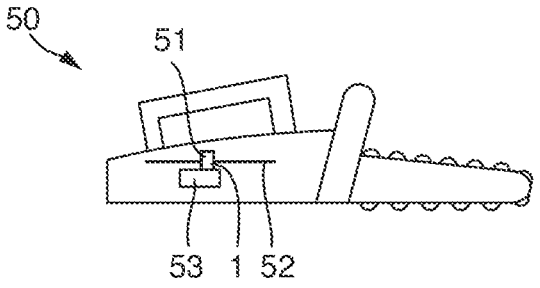
FIG. 9 shows a sectional lateral view of the motor-driven garden and/or forestry working apparatus according to an embodiment of the invention.
Figure 10:
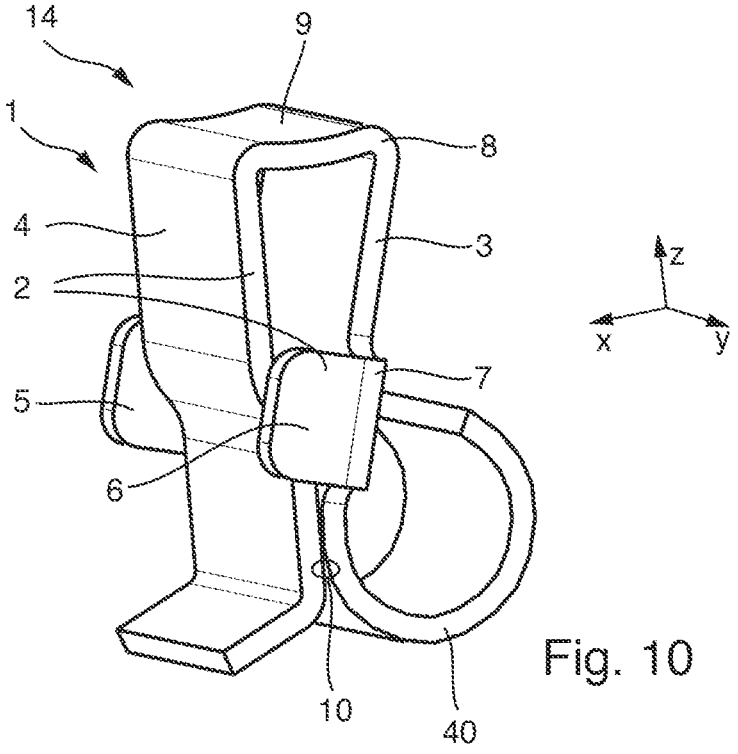
FIG. 10 shows a perspective view of a further plug connector according to an embodiment of the invention.
Figure 11:
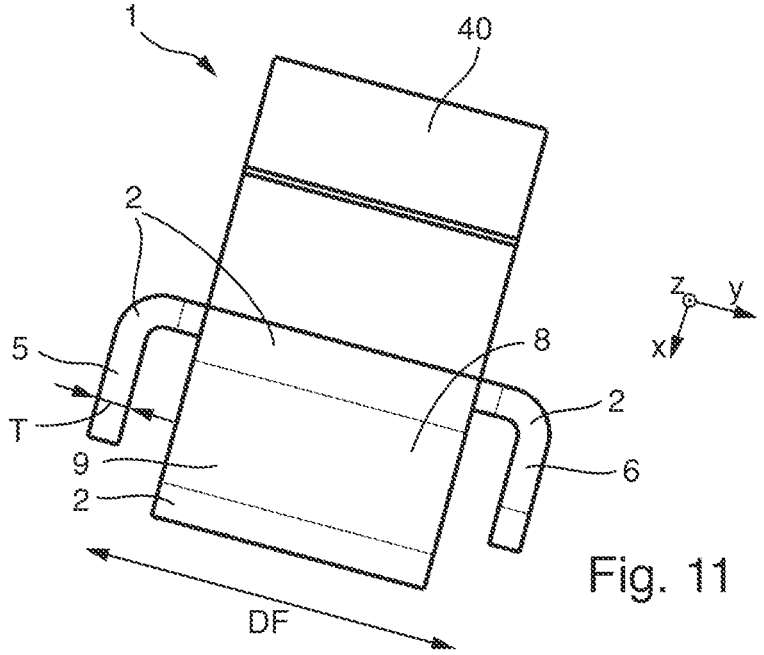
FIG. 11 shows a plan view of the plug connector of FIG. 10.
Figure 12:
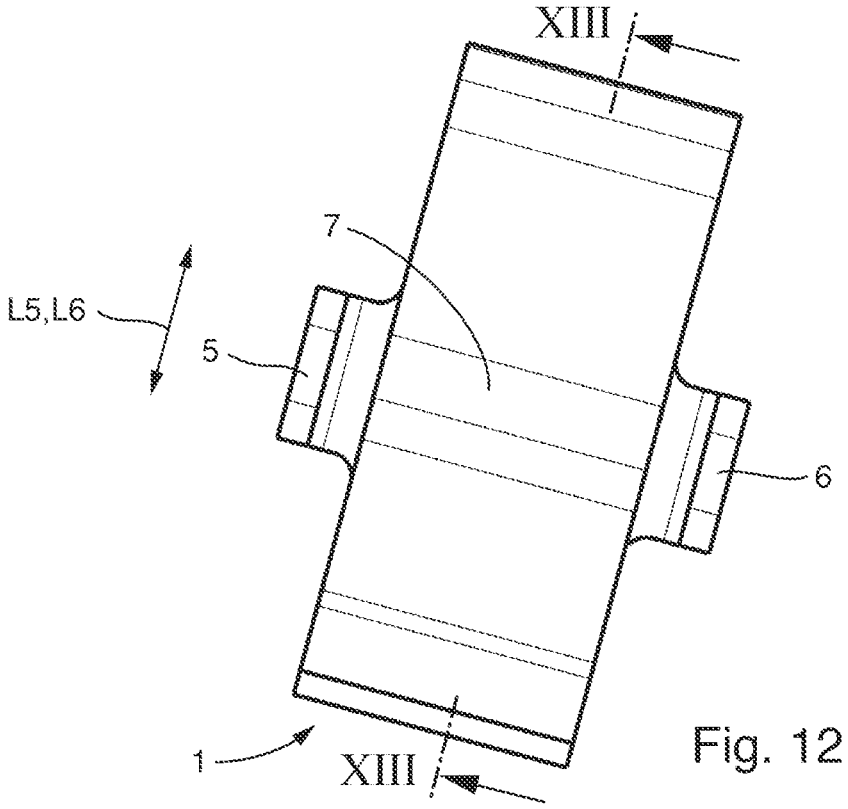
FIG. 12 shows a lateral view of the plug connector of FIG. 10.
Figure 13:
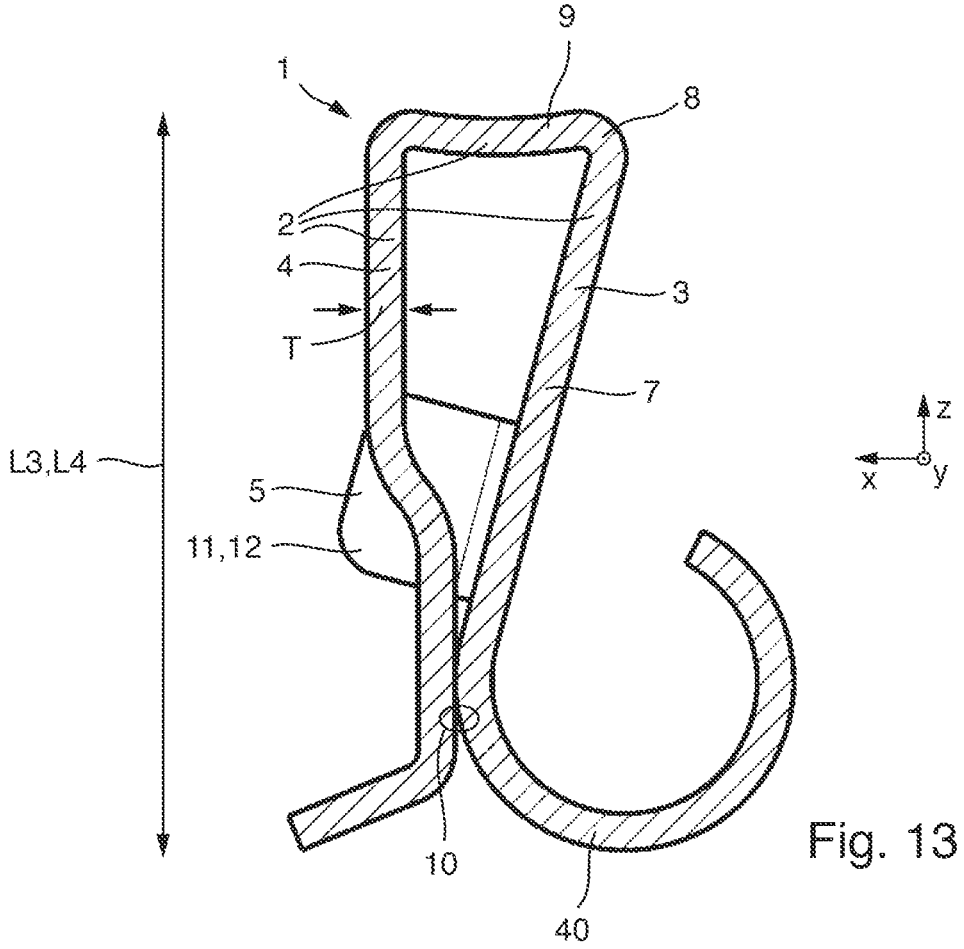
FIG. 13 shows a sectional view of the plug connector of FIG. 10.

FIGS. 1 to 4, 6 to 9, and 10 to 13, show, in particular in each case, a plug connector 1 for electronically connecting a tag connector 51, as is shown in FIGS. 6 to 9, to an electrical line 52, as is shown in FIGS. 8 and 9, of a motor-driven garden and/or forestry working apparatus 50, as is shown in FIG. 9. The plug connector 1 has a tag connector receptacle portion 2 and a line receptacle portion 40. The tag connector receptacle portion 2 has a first surface-clamping leg 3, a second surface-clamping leg 4, a first peripheral guiding blade 5, and a second peripheral guiding blade 6. The surface-clamping legs 3, 4 are disposed so as to be opposite one another. The peripheral guiding blades 5, 6 are disposed so as to be opposite one another. The tag connector receptacle portion 2 is configured for elastically enlarging a leg spacing DS between the surface-clamping legs 3, 4, in particular by means of interaction between the surface-clamping legs 3, 4 and the tag connector 51, for receiving the tag connector 51 between the surface-clamping legs 3, 4. Furthermore, the tag connector receptacle portion 2 is configured for plastically enlarging a blade spacing DF between the peripheral guiding blades 5, 6 by means of interaction between the peripheral guiding blades 5, 6 and the tag connector 51 for receiving the tag connector 51 between the peripheral guiding blades 5, 6. Moreover, the tag connector receptacle portion 2 is configured for contacting and for impinging with a clamping force FK opposite surfaces 51*a*, 51*b* of the received tag connector 51 by means of the surface-clamping legs 3, 4, and for contacting opposite peripheries 51*c*, 51*d* of the received tag connector 51 by means of the peripheral guiding blades 5, 6 for securing the received tag connector 51 against being released from the connector receptacle portion 2 and for electrical contacting. The line receptacle portion 40 is electrically connected to the tag connector receptacle portion 2. Furthermore, the line receptacle portion 40 is configured for receiving the electrical line 52 and for securing the received line 52 against being released from the line receptacle portion 40 and for electrical contacting.

The plug connector 1 in FIGS. 8 and 9 electrically connects the tag connector 51 to the electrical line 52.

The leg spacing DS is elastically enlarged in FIGS. 6 to 9. The tag connector 51 is received between the surface-clamping legs 3, 4. The blade spacing DF is plastically enlarged. The tag connector 51 is received between the peripheral guiding blades 5, 6. The surface-clamping legs 3, 4 contact and by way of the clamping force FK impinge the opposite surfaces 51*a*, 51*b* of the received tag connector 51. The peripheral guiding blades 5, 6 contact the opposite peripheries 51*c*, 51*d* of the received tag connector 51. The received tag connector 51, in particular by means of the surface-clamping legs 3, 4 and the peripheral guiding blades 5, 6, is secured against being released from the tag connector receptacle portion 2. Moreover, the received tag connector 51 is electrically contacted in particular by means of the surface clamping-legs 3, 4 and the peripheral guiding blades 5, 6.

The electrical line 52 is received in particular by means of the line receptacle portion 40 in FIGS. 8 and 9. Furthermore, the received line 52, in particular by means of the line receptacle portion 40, is secured against being released from the line receptacle portion 40. Moreover, the received line 52 is electrically contacted, in particular by means of the line receptacle portion 40.

Specifically, the surface-clamping legs 3, 4 and the peripheral guiding blades 5, 6 are mutually disposed in such a manner that a blade spacing direction y runs so as not to be parallel, in particular so as to be orthogonal, to a leg spacing direction x.

Additionally, the first surface-clamping leg 3, the first peripheral guiding blade 5, the second surface-clamping leg 4 and the second peripheral guiding blade 6 are in this sequence disposed about a tag connector receiving direction z which in particular runs so as not to be parallel, in particular so as to be orthogonal, to the blade spacing direction y and the leg spacing direction x.

In the exemplary embodiments shown, the first peripheral guiding blade 5 in mechanical terms is connected directly to the first surface-clamping leg 3. The second peripheral guiding blade 6 in mechanical terms is connected directly to the first surface-clamping leg 3.

In alternative exemplary embodiments the first peripheral guiding blade in mechanical terms can be connected directly to the second surface-clamping leg. Additionally or alternatively, in alternative exemplary embodiments the second peripheral guiding blade in mechanical terms can be connected directly to the second surface-clamping leg.

Furthermore, in the exemplary embodiments shown, the peripheral guiding blades 5, 6 from the first surface-clamping leg 3 extend in the direction x, in particular in the leg spacing direction x, of the second surface-clamping leg 4, in particular up to the second surface-clamping leg 4.

Additionally, the peripheral guiding blades 5, 6 in the tag connector receiving direction z are disposed in a central region 7 of the surface-clamping legs 3, 4.

Furthermore additionally, the peripheral guiding blades 5, 6 in the tag connector receiving direction z are at most 50% of the length of the surface-clamping legs 3, 4.

Moreover, the peripheral guiding blades 5, 6 in the tag connector receiving direction z are at least 1 mm and/or at most 4 mm long, or a length L5, L6 of the peripheral guiding blades 5, 6 in the tag connector receiving direction z is at least 1 mm and/or at most 4 mm, respectively.

Additionally, the surface-clamping legs 3, 4 in the tag connector receiving direction z are at least 3 mm and/or at most 9 mm long, or a length L3, L4 of the surface-clamping legs 3, 4 in the tag connector receiving direction z is at least 3 mm and/or at most 9 mm.

Furthermore additionally, the leg spacing DS is at least 1 mm and/or at most 3 mm, in particular in the case of a received tag connector 51, and 0 mm prior to the tag connector 51 being initially received in the tag connector receptacle portion 2.

Furthermore additionally, the blade spacing DF is at least 3 mm and/or at most 7 mm, in particular in the case of a received tag connector 51.

Furthermore additionally, the leg spacing DS is at most 50% of the blade spacing DS, in particular in the case of a received tag connector 51.

Furthermore additionally, the surface-clamping legs 3, 4 and/or the peripheral guiding blades 5, 6 are at least 0.25 and/or at most 0.75 mm thick, or a thickness T of the surface-clamping legs 3, 4 and/or of the peripheral guiding blades 5, 6 is at least 0.25 and/or at most 0.75 mm, respectively.

Furthermore, the plug connector 1 in the tag connector receiving direction z in an end region 8 of the surface-clamping legs 3, 4 has a plug-fit delimitation and/or user compression portion 9. The plug-fit delimitation and/or user compression portion 9 is configured for delimiting the receptacle of the tag connector 51, in particular by means of contacting the tag connector 51, and/or for pressing the tag connector receptacle portion 2 in a user-activatable manner onto the tag connector 51.

The plug-fit delimitation and/or user compression portion 9 contacts the received tag connector 51 in FIGS. 6 to 9. Moreover, the received tag connector 51 is electrically contacted by means of the plug-fit delimitation and/or user compression portion 9.

Specifically, the surface-clamping legs 3, 4 in mechanical terms are connected to one another by means of the plug-fit delimitation and/or user compression portion 9.

Additionally, the plug-fit delimitation and/or user compression portion 9 is curved towards the inside, or counter to the tag connector receiving direction z, respectively.

Furthermore, the first surface-clamping leg 3 and/or the second surface-clamping leg 4 in a leg plug-fit region 10 for the tag connector 51 for interacting with the tag connector 51 for elastically enlarging the leg spacing DS are/is moulded in particular so as to be oblique to the tag connector receiving direction z.

In particular, a free end/free ends of the first surface-clamping leg 3 and/or of the second surface-clamping leg 4 are/is angled towards the outside.

Additionally, the first peripheral guiding blade 5 and/or the second peripheral guiding blade 6 in a blade plug-fit region 11 for the tag connector 51 for interacting with the tag connector 51 for plastically enlarging the blade spacing DF are/is moulded in particular so as to be oblique to the tag connector receiving direction z.

In particular, the first peripheral guiding blade 5 and/or the second peripheral guiding blade 6 have/has an introduction ramp 12/introduction ramps 12.

Moreover, in the exemplary embodiments shown, the line receptacle portion 40 in the tag connector receiving direction z is disposed so as to be level with the leg plug-fit region 10 of the first surface-clamping leg 3 and/or of the second surface-clamping leg 4 for the tag connector 51.

In alternative exemplary embodiments the line receptacle portion 40, counter to the tag connector receiving direction z, can be disposed so as to be spaced apart from the leg plug-fit region 10.

Furthermore, the peripheral guiding blades 5, 6 in mechanical terms are connected directly to the first surface-clamping leg 3, as described above. The second surface-clamping leg 4 in mechanical terms is connected to the line receptacle portion 40 by means of the first surface-clamping leg 3.

Moreover, in FIGS. 1 to 8 the tag connector receptacle portion 2, in the shown exemplary embodiment, the first surface-clamping leg 3, and the line receptacle portion 40 in mechanical terms are connected to one another by means of an in particular bent spring portion 13.

In particular, the line receptacle portion 40 by means of the spring portion 13 is bent away from the tag connector receptacle portion 2, in particular counter to the leg spacing direction x.

The line receptacle portion 40 is thus configured as a release aid.

Furthermore, the tag connector receptacle portion 2 and the line receptacle portion 40 are mutually disposed in such a manner that a line receiving direction y runs so as not to be parallel, in particular so as to be orthogonal, to the tag connector receiving direction z, in particular so as to be parallel to the blade spacing direction y.

Moreover, the line receptacle portion 40 is configured so as to form a crimp connection CC, in particular a B crimp connection and/or an overlapping crimp connection, to the electrical line 52.

The line receptacle portion 40 in FIGS. 8 and 9 is connected to the electrical line 52 by means of the crimp connection CC.

Furthermore, the line receptacle portion 40 has a strain relief 41 for the electrical line 52.

The electrical line in FIGS. 8 and 9 is fixed by means of the strain relief 41.

Figure 1:
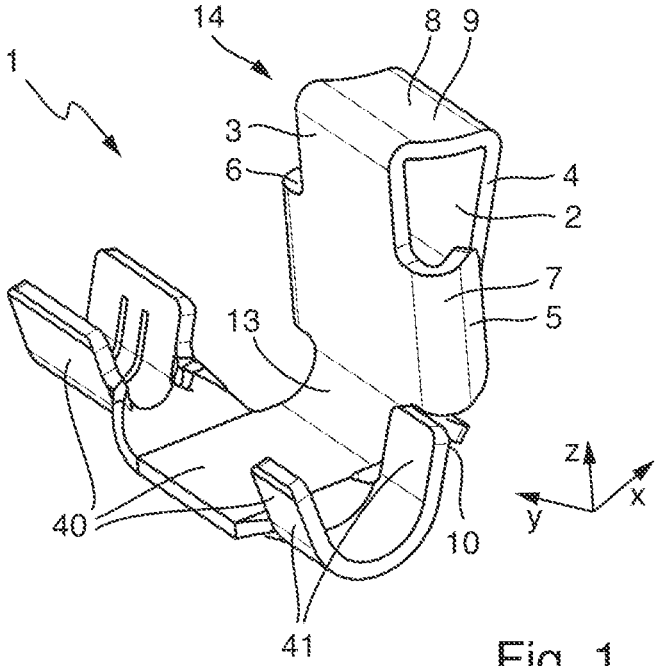
FIG. 1 shows a perspective view of a plug connector according to an embodiment of the invention.
Figure 2:
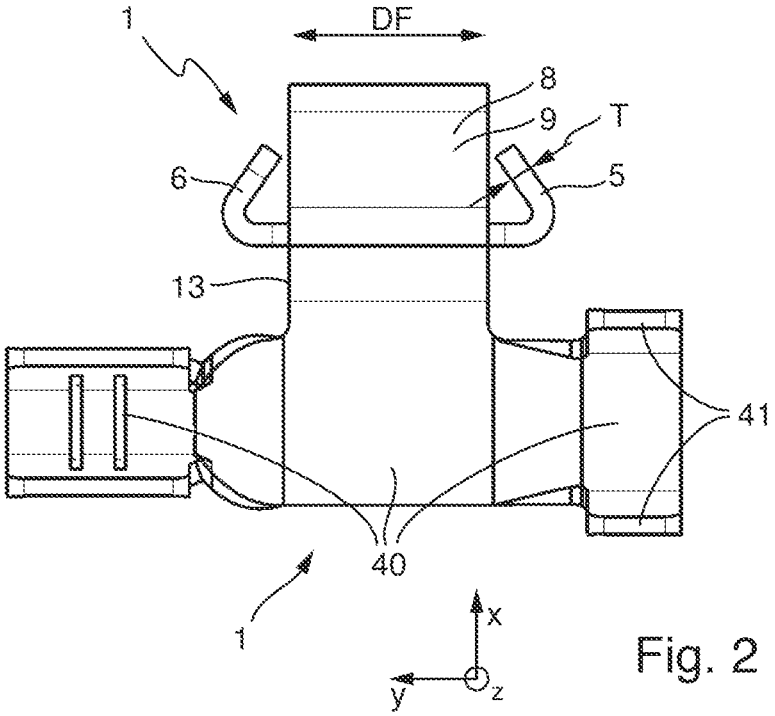
FIG. 2 shows a plan view of the plug connector of FIG. 1.
Figure 3:
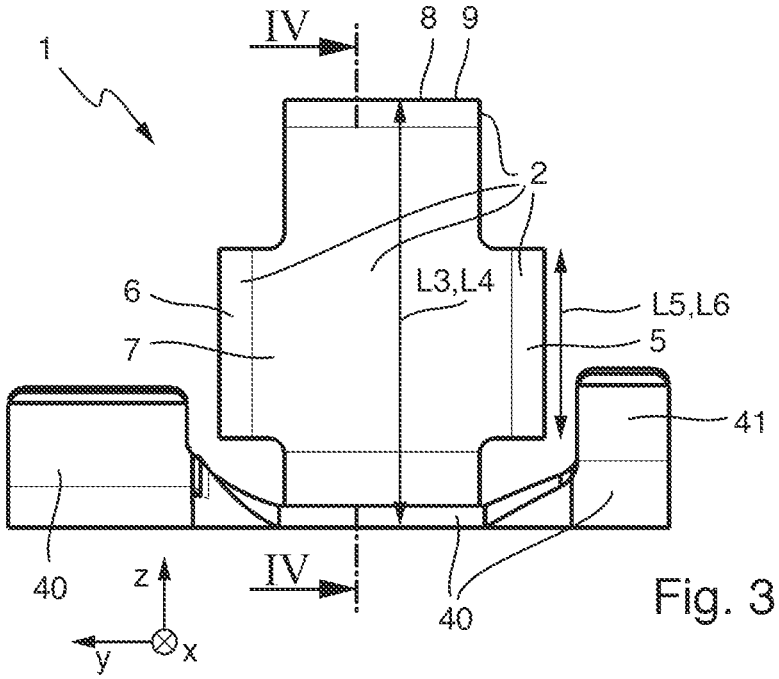
FIG. 3 shows a lateral view of the plug connector of FIG. 1.
Figure 4:
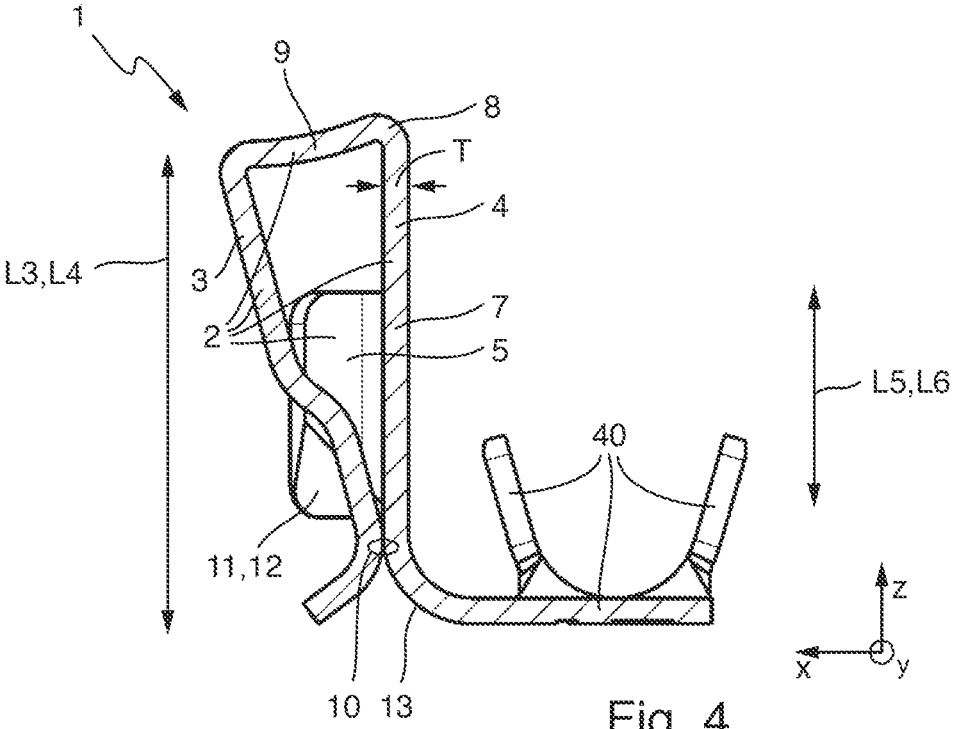
FIG. 4 shows a sectional view of the plug connector of FIG. 1.
Figure 5:
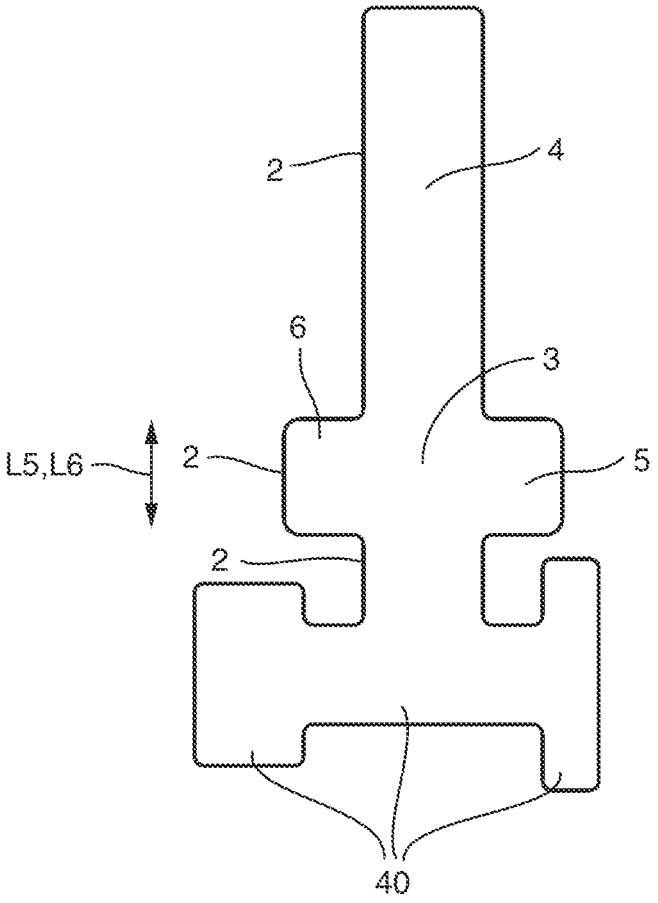
FIG. 5 shows a plan view of a stamped part prior to being bent so as to form the plug connector of FIG. 1.
Figure 6:
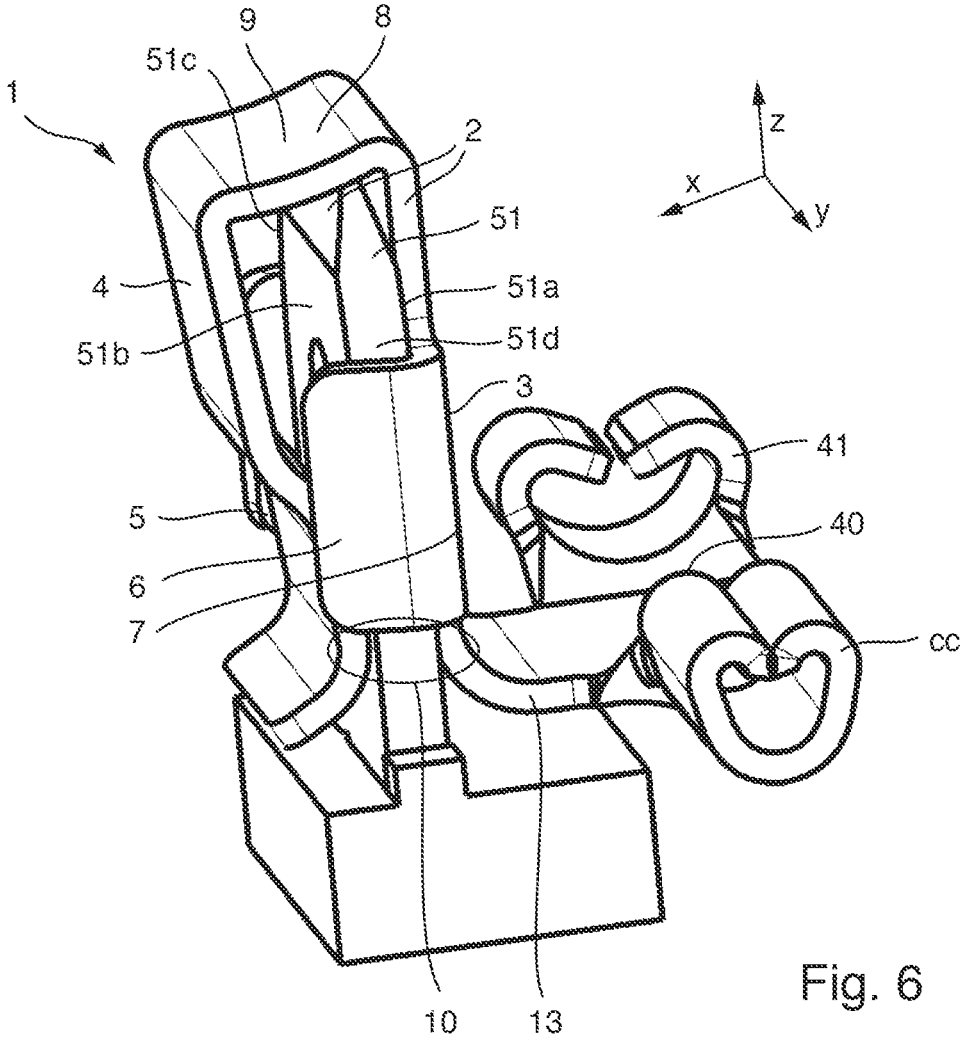
FIG. 6 shows a further perspective view of the plug connector of FIG. 1, having a received tag connector of a motor-driven garden and/or forestry working apparatus.
Figure 7:
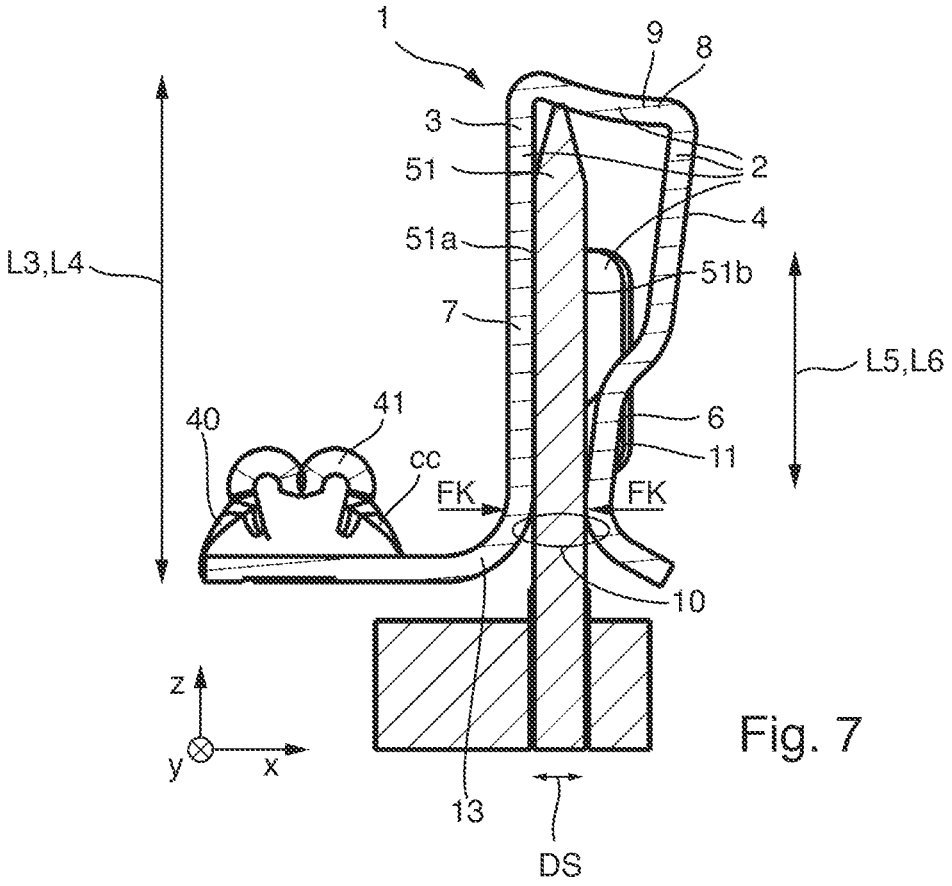
FIG. 7 shows a further sectional view of the plug connector of FIG. 1, having the received tag connector.
Figure 14:
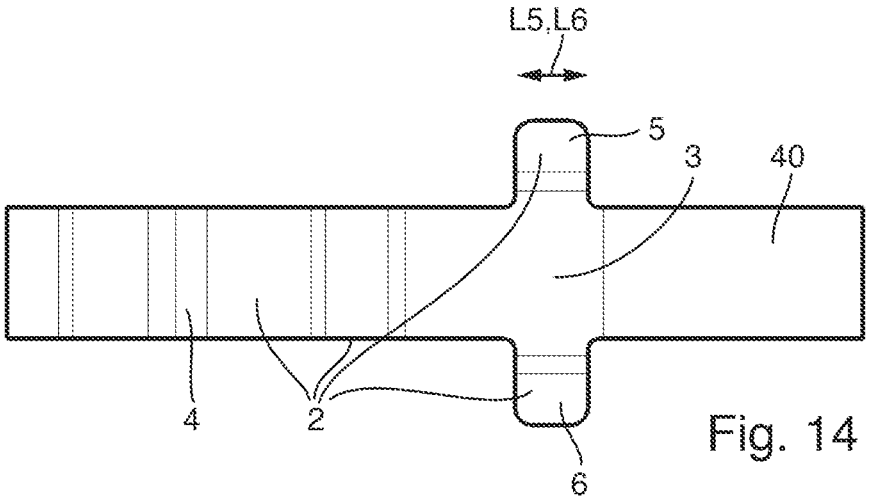
FIG. 14 shows a plan view of a stamped part prior to being bent so as to form the plug connector of FIG. 10.

The plug connector 1 moreover has a stamped-and-bent part 14, in particular is a stamped-and-bent part, as is shown proceeding from FIGS. 5 and 14.

Furthermore, the plug connector 1 is configured in one part.

FIG. 9 shows the motor-driven garden and/or forestry working apparatus 50. The motor-driven garden and/or forestry working apparatus 50 has the tag connector 51, the electrical line 52, and the plug connector 1 as described above. The plug connector 1 electrically connects the tag connector 51 to the line 52.

In particular, the motor-driven garden and/or forestry working apparatus 50 has a motor control unit 53. The motor control unit 53 has the tag connector 51.

The motor-driven garden and/or forestry working apparatus 50 in the exemplary embodiment shown is a saw. In alternative exemplary embodiments the garden and/or forestry working apparatus can be a pole branch cutter, a brush cutter, a hedge cutter, a hedge trimmer, a blower, a leaf blower, a pair of pruning shears, an angle grinder, a sweeping apparatus, a sweeper roller, a sweeper brush, a lawn mower, a lawn scarifier, or a grass cutter.

As is highlighted by the exemplary embodiments shown and explained above, the invention provides a plug connector for electrically connecting a tag connector to an electrical line of a motor-driven garden and/or forestry working apparatus, wherein the plug connector has improved properties, and a motor-driven garden and/or forestry working apparatus having such a plug connector.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A plug connector for electrically connecting a tag connector to an electrical line of a motor-driven garden and/or forestry working apparatus, comprising:

a tag connector receptacle portion, wherein the tag connector receptacle portion has a first surface-clamping leg, a second surface-clamping leg, a first peripheral guiding blade, and a second peripheral guiding blade, wherein the surface-clamping legs are disposed so as to be opposite one another, wherein the peripheral guiding blades are disposed so as to be opposite one another, and wherein the tag connector receptacle portion is configured for elastically enlarging a leg spacing between the surface-clamping legs and for plastically enlarging a blade spacing between the peripheral guiding blades byway of interaction between the peripheral guiding blades and the tag connector for receiving the tag connector between the surface-clamping legs and the peripheral guiding blades, and for contacting and for impinging with a clamping force opposite surfaces of the received tag connector by way of the surface-clamping legs, and for contacting opposite peripheries of the received tag connector by way of the peripheral guiding blades for securing the received tag connector against being released from the tag connector receptacle portion and for electrical contacting; and a line receptacle portion, wherein the line receptacle portion is electrically connected to the tag connector receptacle portion, and wherein the line receptacle portion is configured for receiving the electrical line and for securing the received line against being released from the line receptacle portion and for electrical contacting.

2. The plug connector according to claim 1, wherein at least one of:

the surface-clamping legs and the peripheral guiding blades are mutually disposed in such a manner that a blade spacing direction runs so as not to be parallel to a leg spacing direction, and the first surface-clamping leg, the first peripheral guiding blade, the second surface-clamping leg and the second peripheral guiding blade are disposed in this sequence about a tag connector receiving direction.

3. The plug connector according to claim 1, wherein at least one of:

the first peripheral guiding blade in mechanical terms is connected directly to the first surface-clamping leg or to the second surface-clamping leg, and the second peripheral guiding blade in mechanical terms is connected directly to the first surface-clamping leg or to the second surface-clamping leg.

4. The plug connector according to claim 1, wherein at least one of:

the peripheral guiding blades from the first surface-clamping leg extend in the direction of the second surface-clamping leg up to the second surface-clamping leg, the peripheral guiding blades in a tag connector receiving direction are disposed in a central region of the surface-clamping legs, and the peripheral guiding blades in the tag connector receiving direction are at most 50% of the length of the surface-clamping legs.

5. The plug connector according to claim 1, wherein at least one of:

the peripheral guiding blades in a tag connector receiving direction are at least 1 mm and/or at most 4 mm long, the surface-clamping legs in the tag connector receiving direction are at least 3 mm and/or at most 9 mm long, the leg spacing is at least 1 mm and/or at most 3 mm, the blade spacing is at least 3 mm and/or at most 7 mm, the leg spacing is at most 50% of the blade spacing, and the surface-clamping legs and/or the peripheral guiding blades are at least 0.25 and/or at most 0.75 mm thick.

6. The plug connector according to claim 1, wherein the plug connector in a tag connector receiving direction in an end region of the surface-clamping legs has a plug-fit delimitation and/or user compression portion, and the plug-fit delimitation and/or user compression portion is configured for delimiting the receptacle of the tag connector and/or for pressing the tag connector receptacle portion in a user-activable manner onto the tag connector.

7. The plug connector according to claim 6, wherein the surface-clamping legs in mechanical terms are connected to one another by way of the plug-fit delimitation and/or user compression portion, and the plug-fit delimitation and/or user compression portion is curved towards the inside.

8. The plug connector according to claim 1, wherein at least one of:

the first surface-clamping leg and/or the second surface-clamping leg in a leg plug-fit region for the tag connector for interacting with the tag connector for elastically enlarging the leg spacing are/is molded so as to be oblique, and the first peripheral guiding blade and/or the second peripheral guiding blade in a blade plug-fit region for the tag connector for interacting with the tag connector for plastically enlarging the blade spacing are/is molded so as to be oblique and so as to have an introduction ramp/introduction ramps.

9. The plug connector according to claim 1, wherein the line receptacle portion in a tag connector receiving direction is disposed so as to be level with a leg plug-fit region of the first surface-clamping leg and/or of the second surface-clamping leg for the tag connector, or counter to the tag connector receiving direction so as to be spaced apart from the leg plug-fit region.

10. The plug connector according to claim 1, wherein the peripheral guiding blades in mechanical terms are connected directly to the first surface-clamping leg, and the second surface-clamping leg in mechanical terms is connected to the line receptacle portion by way of the first surface-clamping leg.

11. The plug connector according to claim 1, wherein the tag connector receptacle portion and the line receptacle portion in mechanical terms are connected to one another by way of a bent spring portion.

12. The plug connector according to claim 1, wherein the tag connector receptacle portion and the line receptacle portion are mutually disposed in such a manner that a line receiving direction runs so as not to be parallel to a tag connector receiving direction and so as to be parallel to a blade spacing direction.

13. The plug connector according to claim 1, wherein the line receptacle portion is configured so as to form a crimp connection to the electrical line.

14. The plug connector according to claim 1, wherein the plug connector is a stamped-and-bent part free of any welded connection.

15. A motor-driven garden and/or forestry working apparatus, comprising:

a tag connector;

an electrical line; and a plug connector according to claim 1, wherein the plug connector electrically connects the tag connector to the electrical line.

* * * * *